US008425179B2

(12) United States Patent
Hesting

(10) Patent No.: US 8,425,179 B2
(45) Date of Patent: Apr. 23, 2013

(54) HESTING POWER TURBINE DEVICE

(76) Inventor: Daniel O. Hesting, Wichita, KS (US)

( * ) Notice: Subject to any disclaimer, the term of this patent is extended or adjusted under 35 U.S.C. 154(b) by 925 days.

(21) Appl. No.: 12/538,870

(22) Filed: Aug. 11, 2009

(65) Prior Publication Data

US 2010/0111672 A1 May 6, 2010

Related U.S. Application Data

(60) Provisional application No. 61/091,216, filed on Aug. 22, 2008.

(51) Int. Cl.
*F01D 5/04* (2006.01)

(52) U.S. Cl.
USPC ..... 415/90; 415/92; 415/203; 415/208.2; 415/208.3; 416/20 R; 416/197 B; 416/197 C; 416/197 R

(58) Field of Classification Search ..... 415/92, 415/203, 208.3; 416/20 R, 106, 197 B, 197 C, 416/197 R
See application file for complete search history.

(56) References Cited

U.S. PATENT DOCUMENTS

| | | | | | |
|---|---|---|---|---|---|
| 1,645,855 | A | * | 10/1927 | De Vore | 415/64 |
| 1,793,179 | A | * | 2/1931 | Lanterman et al. | 415/87 |
| 2,603,300 | A | * | 7/1952 | King | 416/10 |
| 4,411,591 | A | * | 10/1983 | Hesting | 415/103 |
| 4,586,871 | A | * | 5/1986 | Glass | 415/90 |
| 4,866,321 | A | * | 9/1989 | Blanchard et al. | 310/112 |
| 5,120,196 | A | * | 6/1992 | By et al. | 416/180 |

FOREIGN PATENT DOCUMENTS

GB 2103715 A * 2/1983

* cited by examiner

*Primary Examiner* — Igor Kershteyn
(74) *Attorney, Agent, or Firm* — Wilson Daniel Swayze, Jr.

(57) ABSTRACT

A power turbine employs a plurality of turbine blades which allows the turbine to regulate pressure and ventilate for a greater ability to generate power without back pressure of the power source. It also relieves much of the stress on the uni-body construction. The vent ports (30) work at various times to transfer pressure naturally from one compartment to another, greatly increasing the balance of pressure throughout the process within the turbine.

8 Claims, 3 Drawing Sheets

HESTING POWER TURBINE DEVICE

PREVIOUS APPLICATION

This application emanates from a previous application; 61/091,216 filed Aug. 22, 2008

FIELD OF THE INVENTION

The present invention relates generally to pressurized turbines, and, more specifically, to turbine shrouds and blade designs.

BACKGROUND OF THE INVENTION

In a gas turbine engine, air is pressurized in a compressor, mixed with fuel in a combustor, and ignited for generating hot combustion gases which flow downstream through one or more turbine stages which extract energy there from. A high pressure turbine (HPT) first receives the combustion gases from the combustor and extracts energy there from for powering the compressor. A low pressure turbine (LPT) follows the HPT for extracting additional energy for providing output energy typically used for powering a fan disposed upstream of the compressor in a typical aircraft gas turbine engine application.

Turbine engines are known in the art and provide for the operation of electrical energy or production of mechanical work for transfer to associated apparatuses. Steam turbines employ the energy of a flowing fluid stream for conversion into mechanical energy. In operation of turbines it is important that the working fluid flow steadily through the turbine and that the transfer of heat through the turbine housing is negligible. The power developed for unit mass flow of fluid corresponds to the measurable difference of components in a fluid property called specific stagnation enthalpy. This fluid property comprises essentially of two parts. Enthalpy is a thermal dynamic property which in steam is a function of pressure and temperature. The second part is the kinetic energy due to motion of the fluid through the turbine. Thus, it can be appreciated that the maintenance of a fluid flow through the turbine is of importance.

Steam turbines are still in various states of evolution. In modern use the density of the steam at turbine entry, especially in multistage turbines, can be significantly greater than that at the exit. To provide responsive blades to such difference and to keep the blade heights of the turbine within practical bounds, it is desirable to divide the fluid flow. Thus, the turbine has been divided into multistage compartments including a high pressure compartment which transmits some of the steam back to the boiler for reheating, an intermediate pressure compartment and, if desired, a low pressure compartment. All compartments have turbine blades therein attached to the turbine shaft. Thus, it is of importance to have an effective blade response to this expanding steam as well as efficient fluid movement from one pressure compartment of the turbine to the other.

Accordingly, Applicant has invented a more efficient turbine by ventilating and regulating the turbine to increase the momentum of the turbine, as well as the control over the pressure to allow more efficient conversion into horse power for an electric generator.

SUMMARY OF THE INVENTION

The turbine device is a power converter usable with pressurized sources such as steam, air, and water. Applicant's U.S. Pat. No. 4,411,591 in 1983 was constructed in a similar way. Applicant's work on it was the foundation for the concept of a vertical rotating turbine device. At the present, the improvement concept is to manage pressurized sources listed above, more efficiently by ventilating and regulating the turbine to increase the momentum of the turbine, as well as the control over the pressure to allow more efficient conversion into horse power for an electric generator.

The pressure management allows this conversion, because it allows the device more pressure range from within the unit itself, at the collector blades (26). The regulator blades (28), at the center, keeps the pressure in balance as the centrifugal momentum increases away from center. This allows the turbine to regulate pressure and ventilate for a greater ability to generate power without back pressure of the power source. It also relieves much of the stress on the uni-body construction. The vent ports (30) work at various times to transfer pressure naturally from one compartment to another, greatly increasing the balance of pressure throughout the process within the turbine.

The turbine is intended to be used with any pressurized source, air, fluid, or steam. The power output will increase exponentially to the power input.

The turbine can be used within the automotive industry, in developing an electric vehicle. Any business or industry developing alternative electric sources or individuals wishing to develop a home electric power system.

The current device does not depend upon fossil fuels. It has fewer working parts than most turbines, due to the unibody construction. The device requires little maintenance. This turbine gives consumers more freedom of choice to supply their energy needs at a more affordable cost.

Most types of power generation today require fossil fuel or coal. This pollutes the environment and the sources are limited. Alternatives such as wind turbines are so large they are prohibitly expensive for all but large utilities. This device allows the safe generation of power on an individual scale. There is very little opportunity for fire or explosion using air or water. The device is in a managable size for home or automotive use.

BRIEF DESCRIPTION OF THE EMBODIMENT

FIG. 1 is the Turbine 10 embodiment.
FIG. 2 is the Ventilated Disc 20;
FIG. 3 is the Simple Disc 24
FIG. 4 is the Pressure Management Disc 22.

DESCRIPTION OF THE PREFERRED EMBODIMENT

Referring more particularly to the drawings, FIG. 1, showing a turbine housing having three functional inlet compartments; left, center and right. Each has one inlet port (12) at the apex of the Turbine Block (10). Each compartment has one outlet port (14) at the base of the turbine block (10).

The turbine torque shaft (18) is connected to bearing systems (16) left and right sides, and extends outward from the pressure management disc (22).

The turbine compartments are formed by placing together discs to form working units. The discs are cast having a left and right pattern. For example, Ventilated Disc (20) (FIG. 2), as shown in FIG. 1, is put together with power management disc (22) (FIG. 4) to form the left and right compartments within the turbine. Simple Disc (24) (FIG. 3), together with another ventilated disc (20), forms the center compartment of the Turbine.

FIGS. 2, 3 and 4, are drawings of individual discs (20, 22, and 24) showing the details of each.

FIG. 2, Ventilated Disc (20) has collector blades (26) that are placed at a calculated curve extending away from the center, to receive inlet pressure. regulator blades (28), also cast into the disc, regulate inlet pressure as the cycle begins within the compartments. They continue the cycling process as energy and momentum increases, and allows direct and indirect outlet pressure to cycle through the units.

ventilation holes (30) work naturally with pressure to help form a balance between compartments as centrifugal momentum is expanding outward from center.

Figure 1:
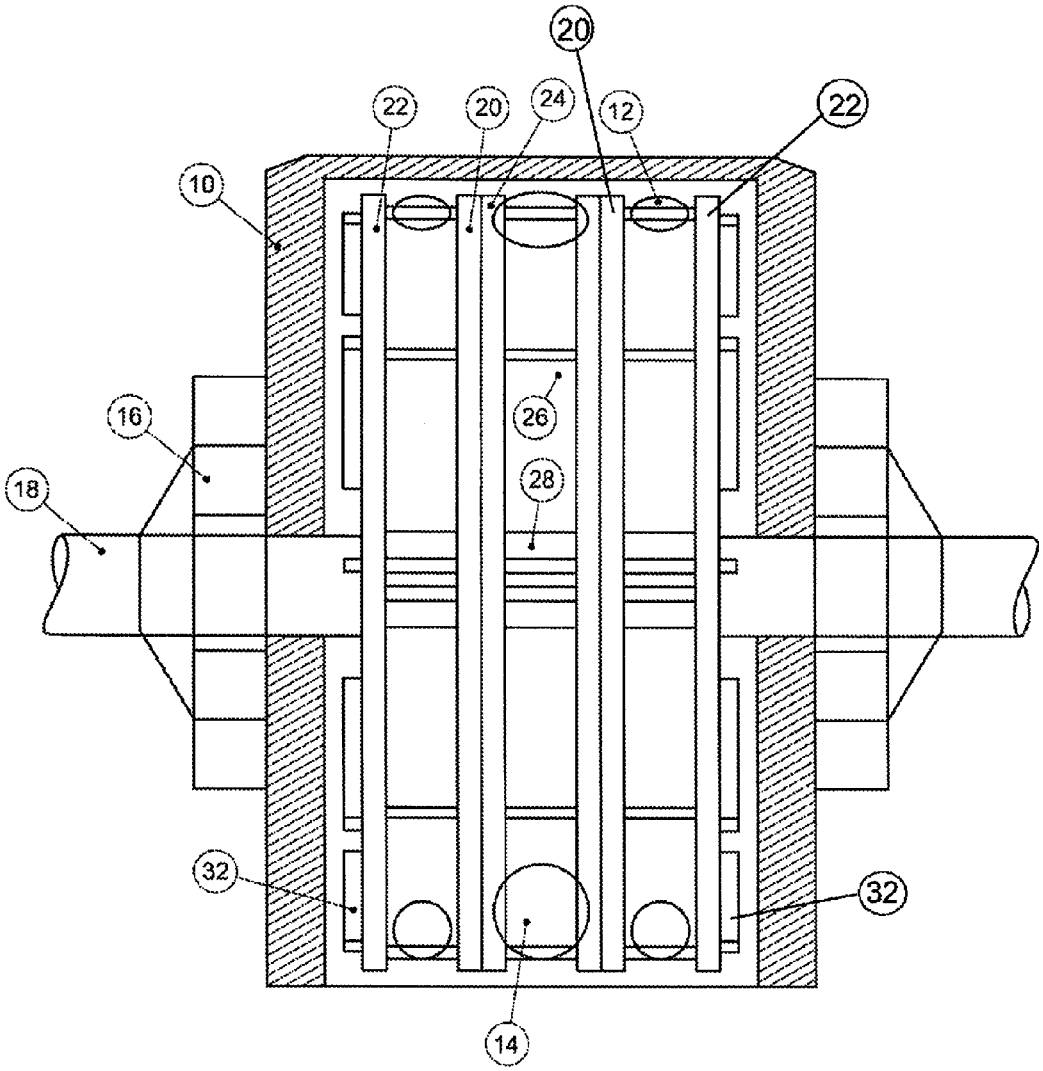
Figure 2:
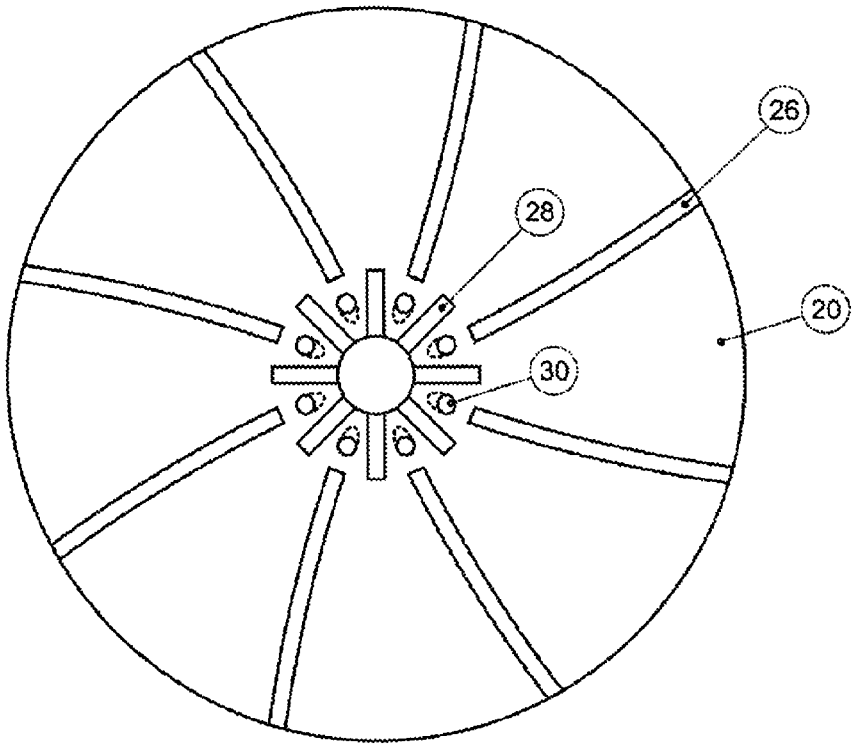
Figure 3:
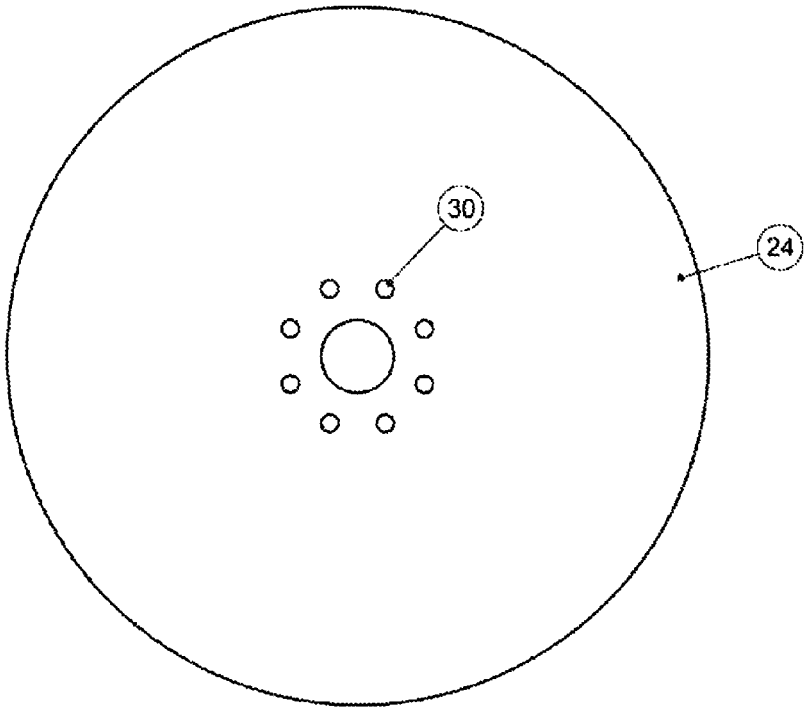
FIG. 3 shows simple disc (24) that is used to form the center compartment of FIG. 1. It shows ventilation holes (30) that are aligned with adjacent (to the left) Ventilated Disc (20).
Figure 4:
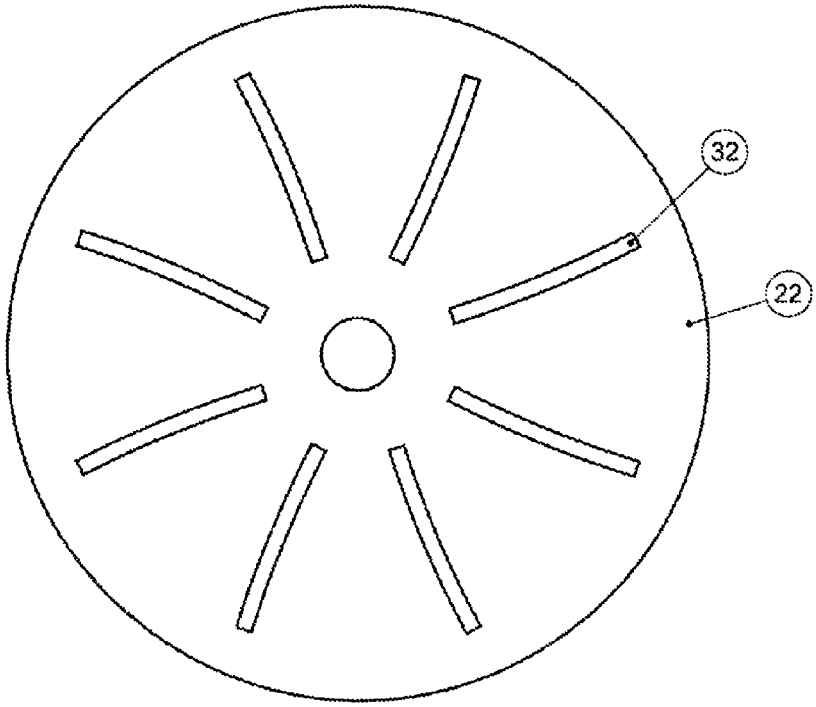
FIG. 4 shows Pressure Management Disc (22) that forms the outside left and right compartments, along with Ventilated Disc (20) on the inside. This disc has Pressure Management Blades (32) that keep pressure away from the bushings and bearings by forcing the pressure back into the center of the Inlet Compartment of Disc (20).

Description of turbine embodiment of FIG. 1:

| | |
|---|---|
| #10 | Turbine Block Casing |
| #12 | Power Inlets |
| #14 | Power Outlets |
| #16 | Bearings |
| #18 | Power shaft |
| #20 | Ventilated Disc |
| #22 | Pressure Management Disc |
| #24 | Simple Disc |
| #26 | Collector Blades |
| #28 | Regulator Blades |
| #32 | Pressure Management Blade |

What is claimed is:

1. A ventilated power turbine disc (20) able to cycle the inlet power through the center of the ventilated disc unit comprising collector blades (26) with a curve which extends to the periphery of the ventilated power turbine disc, that are cast into the ventilated disc.

2. A ventilated power turbine disc as in claim 1, wherein the ventilated turbine powered disc has a center of ventilated disc (20) including eight regulator blades (28) that are placed between and just extending into inlet compartments, and are cast into the ventilated disc (20).

3. A ventilated power turbine disc according to claim 2, wherein ventilation holes (30) are placed between the regulator blades (28) and work with the process of transferring pressure into adjacent disc units.

4. A ventilated power turbine disc according to claim 1 wherein the power turbine disc includes a simple disc (24) having ventilation holes (30) to transfer pressure naturally within the operating process.

5. A ventilated power turbine disc according to claim 1 wherein the power turbine disc includes pressure management blades (32) being cast into the pressure management disc (22) having a curve to align the pressure collector blades (26) on ventilated disc (20) to perform the function of keeping the pressure focused to the center of ventilated disc (20) in the inlet compartment.

6. A ventilated power turbine disc according to claim 1 wherein the ventilated power turbine disc is mounted in a turbine unit including at least one inlet port (12) and outlet port (14) placed at the center of each compartment.

7. A ventilated power turbine disc according to claim 6 wherein the inlet port (12) are positioned at an angle to pressurize the compartments within the turbine.

8. A ventilated power turbine disc according to claim 5 wherein the ventilated power turbine disc is connected to a torque shaft to connect to the pressure management disc (22).

* * * * *